US008004257B2

(12) United States Patent
Imura et al.

(10) Patent No.: US 8,004,257 B2
(45) Date of Patent: Aug. 23, 2011

(54) VOLTAGE REGULATOR

(75) Inventors: Takashi Imura, Chiba (JP); Takao Nakashimo, Chiba (JP)

(73) Assignee: Seiko Instruments Inc. (JP)

( * ) Notice: Subject to any disclaimer, the term of this patent is extended or adjusted under 35 U.S.C. 154(b) by 201 days.

(21) Appl. No.: 12/378,185

(22) Filed: Feb. 11, 2009

(65) Prior Publication Data

US 2009/0206807 A1 Aug. 20, 2009

(30) Foreign Application Priority Data

Feb. 15, 2008 (JP) ..... 2008-034204

(51) Int. Cl.
*G05F 1/573* (2006.01)

(52) U.S. Cl. ..... 323/277

(58) Field of Classification Search ..... 323/259, 323/272, 277, 282, 284
See application file for complete search history.

(56) References Cited

U.S. PATENT DOCUMENTS 6,831,626 B2 * 12/2004 Nakamura et al. ..... 345/101
2008/0024099 A1 * 1/2008 Oki et al. ..... 323/282
2009/0278518 A1 * 11/2009 Takagi ..... 323/282

OTHER PUBLICATIONS

Patent Abstracts of Japan, publication No. 02-189608, publication date Jul. 25, 1990.

* cited by examiner

*Primary Examiner* — Adolf Berhane
*Assistant Examiner* — Yemane Mehari
(74) *Attorney, Agent, or Firm* — Adams & Wilks

(57) ABSTRACT

A voltage regulator has a first error amplifier circuit that amplifies a difference between a first reference voltage and a voltage based on an output voltage of an output transistor, and an overcurrent protection circuit that detects an overcurrent flowing through the output transistor and limits a current of the output transistor. The overcurrent protection circuit has an output current detection transistor that feeds a detection current in accordance with an output current of the output transistor, a voltage generation circuit that generates a voltage based on the detection current, a second error amplifier circuit that amplifies a difference between the voltage from the voltage generation circuit and a voltage set by a second reference voltage supplied by a temperature detection circuit and a voltage based on the output voltage, and an output current limiting transistor that controls a gate voltage of the output transistor and has a gate that is controlled by an output of the second error amplifier circuit.

14 Claims, 3 Drawing Sheets

VOLTAGE REGULATOR

BACKGROUND OF THE INVENTION

1. Field of the Invention

The present invention relates to a voltage regulator that outputs a constant voltage, and more particularly, to an overcurrent protection circuit that reduces an output current to protect a circuit when an overcurrent flows into an output terminal.

2. Description of the Related Art

Voltage regulators are employed as voltage supply sources of circuits in various electronic devices. A function of the voltage regulator is to output a constant voltage to an output terminal without being affected by a voltage variation of an input terminal. Moreover, it is important that the voltage regulator has a function of overcurrent protection in which an output current is reduced to protect a circuit when a current that is supplied to a load from the output terminal increases and exceeds a rated current by a predetermined value (for example, refer to JP 02-189608 A).

FIG. 5 illustrates a circuit diagram of a voltage regulator including an overcurrent protection circuit. The conventional voltage regulator including the overcurrent protection circuit includes an output voltage divider circuit 2 that divides a voltage of an output terminal Vout, a reference voltage circuit 3 that outputs a reference voltage, an error amplifier 4 that compares the divided voltage with the reference voltage, an output transistor 1 that is controlled by an output voltage of the error amplifier 4, and an overcurrent protection circuit 50. The overcurrent protection circuit 50 includes an output current detection transistor 5 and a detection resistor 6 which form an output current detection circuit connected in parallel to the output transistor 1, and a transistor 7, a resistor 8, and an output current control transistor 9 which form an output current limiting circuit that is controlled by a voltage of the detection resistor 6.

The overcurrent protection circuit 50 as described above has a function of protecting a circuit from an overcurrent through the following operation.

In the case where an output current of the output terminal Vout increases, a detection current in accordance with the output current flows through the output current detection transistor 5. The detection current flows through the detection resistor 6, thereby allowing a voltage between a gate and a source of the transistor 7 to increase. In this case, the overcurrent flows into the output terminal Vout, and the voltage between the gate and the source of the transistor 7 exceeds a threshold voltage, whereby a drain current flows through the transistor 7. When the drain current of the transistor 7 flows through the resistor 8, a voltage between a gate and a source of the output current control transistor 9 decreases. Accordingly, a drain current flows through the output current control transistor 9, thereby allowing a voltage between a gate and a source of the output transistor 1 to increase. The overcurrent protection circuit 50 operates in this manner, and accordingly the output current of the output terminal Vout is suppressed to have fold-back drooping current-voltage characteristics.

FIG. 6 illustrates a graph of the fold-back drooping current-voltage characteristics. In the current-voltage characteristics, a value of the output current on which the overcurrent protection circuit acts is called a limit current. Further, a value of the output current when the output terminal Vout is short-circuited and the output voltage is equal to a ground potential is called a short-circuit current.

However, in the conventional overcurrent protection circuit 50, accuracy of a current value of the limit current decreases due to a process variation that is generated when the transistor 7 is manufactured. In addition, accuracy of the short-circuit current decreases due to a variation generated in the resistor 6. However, it is difficult to adjust the transistor 7 and the resistor 6 with accuracy when they are manufactured.

For this reason, there occurs a problem that, when the limit current is set to be small, variations in short-circuit current causes deterioration of starting characteristics of the voltage regulator because of a relationship between the output current and the output voltage. In other words, it is difficult to sufficiently reduce the limit current for securing the starting characteristics of the voltage regulator.

Further, an internal temperature of the voltage regulator increases as a result of effects of heat generation caused by the overcurrent, an ambient temperature, and the like. However, in the conventional overcurrent protection circuit 50, it is impossible to control the limit current value and the short-circuit current value by the internal temperature of the voltage regulator.

SUMMARY OF THE INVENTION

The present invention has been made to solve the above-mentioned problems, and therefore an object thereof is to provide a voltage regulator including an overcurrent protection circuit in which accuracy of a limit current value and a short-circuit current value is enhanced.

In order to solve the conventional problems, the voltage regulator including the overcurrent protection circuit according to the present invention is configured as follows.

(1) In order to achieve the above-mentioned object, according to a first aspect of the present invention, there is provided a voltage regulator including: a first error amplifier circuit for amplifying a difference between a first reference voltage and a voltage based on an output voltage of an output transistor, outputting the amplified difference, and controlling a gate of the output transistor; and an overcurrent protection circuit for detecting that an overcurrent flows through the output transistor and limiting a current of the output transistor, in which the overcurrent protection circuit includes: an output current detection transistor in which a gate thereof is controlled by an output voltage of the first error amplifier circuit, for feeding a detection current in accordance with an output current of the output transistor; a voltage generation circuit for generating a voltage based on the detection current; a second error amplifier circuit for amplifying a difference between a voltage set by a second reference voltage and a voltage based on the output voltage, and the voltage of the voltage generation circuit, and outputting the amplified difference; and an output current limiting transistor in which a gate thereof is controlled by an output of the second error amplifier circuit, for controlling a gate voltage of the output transistor.

(2) According to a second aspect of the present invention, there is provided a voltage regulator according to Item (1), in which the second reference voltage is supplied from the same circuit as the first reference voltage.

(3) According to a third aspect of the present invention, there is provided a voltage regulator according to Item (1), in which the second reference voltage is supplied from a temperature detection circuit in which an output voltage thereof changes in accordance with temperature.

(4) According to a fourth aspect of the present invention, there is provided a voltage regulator according to Item (3), in which: the temperature detection circuit includes a constant current circuit and a diode which are connected in series; and the second reference voltage is output in accordance with a forward voltage of the diode.

According to the voltage regulator including the overcurrent protection circuit of the present invention, the overcurrent protection circuit is formed so that the output current is controlled by the second error amplifier circuit which amplifies the difference between the voltage set by the second reference voltage and the voltage based on the output voltage, and the voltage of the voltage generation circuit and outputs the amplified difference. Accordingly, it is possible to provide the voltage regulator including the overcurrent protection circuit, which is capable of enhancing accuracy of the limit current value and the short-circuit current value irrespective of a process variation in manufacturing, and suppressing electric power loss when the overcurrent flows through the output transistor.

Further, the second reference voltage is supplied from the temperature detection circuit in which the output voltage thereof changes in accordance with the temperature, and hence the limit current value and the short-circuit current value can be controlled in accordance with temperature, which enables to suppress heat generation more effectively.

DETAILED DESCRIPTION OF THE PREFERRED EMBODIMENTS

Figure 1:
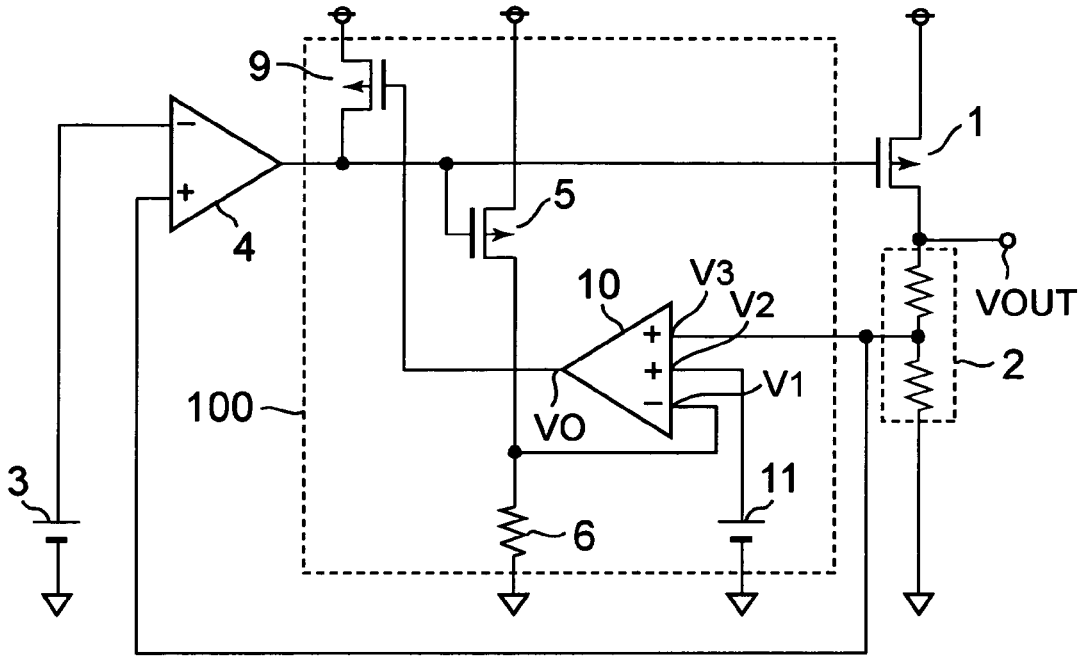
FIG. 1 is a circuit diagram of a voltage regulator including an overcurrent protection circuit according to a first embodiment of the present invention.

FIG. 1 is a circuit diagram of a voltage regulator according to a first embodiment of the present invention.

The voltage regulator according to the first embodiment includes an output transistor 1 which is a PMOS transistor, an output voltage divider circuit 2, a reference voltage circuit 3 (first reference voltage circuit), an error amplifier 4 (first error amplifier), and an overcurrent protection circuit 100. The overcurrent protection circuit 100 includes an output current detection transistor 5 which is a PMOS transistor, a detection resistor 6 (voltage generation circuit), an output current control (limiting) transistor 9 which is a PMOS transistor, a second error amplifier 10 (second error amplifier), and a second reference voltage circuit 11.

The output voltage divider circuit 2 has an input terminal connected to an output terminal Vout and an output terminal connected to a non-inverting input terminal of the error amplifier 4. The reference voltage circuit 3 has an output terminal connected to an inverting input terminal of the error amplifier 4. The error amplifier 4 has an output terminal connected to a gate of the output transistor 1. The output transistor 1 has a source connected to an input power supply and a drain connected to the output terminal Vout. The output current detection transistor 5 has a gate connected to the output terminal of the error amplifier 4, a source connected to the input power supply, and a drain connected to one terminal of the detection resistor 6. The detection resistor 6 has the other terminal connected to a ground. The second error amplifier 10 has an inverting input terminal connected to the one terminal of the detection resistor 6, one non-inverting input terminal connected to an output terminal of the second reference voltage circuit 11, and the other non-inverting input terminal connected to the output terminal of the output voltage divider circuit 2. An output terminal of the second error amplifier 10 is connected to a gate of the output current control transistor 9. The output current control transistor 9 has a source connected to the input power supply and a drain connected to the gate of the output transistor 1.

The output voltage divider circuit 2 divides a voltage of the output terminal Vout and outputs a divided voltage Vdiv. The reference voltage circuit 3 outputs a reference voltage Vref. The error amplifier 4 compares the divided voltage Vdiv with the reference voltage Vref, amplifies a difference therebetween, and outputs the amplified difference. The output transistor 1 is controlled by an output voltage of the error amplifier 4 and operates so that the divided voltage Vdiv is equal to the reference voltage Vref. As a result, the voltage of the output terminal Vout is kept constant.

The overcurrent protection circuit 100 monitors a current flowing through the output transistor 1. The overcurrent protection circuit 100 has a function of controlling the gate of the output transistor 1 to reduce the current when detecting that an overcurrent flows through the output transistor 1.

The gate of the output current detection transistor 5 and the gate of the output transistor 1 are connected with each other, and hence drain currents thereof are proportional to each other. The detection resistor 6 generates a voltage by means of the drain current of the output current detection transistor 5. The voltage generated in the detection resistor 6 is input to the inverting input terminal of the second error amplifier 10. Accordingly, when the voltage generated in the detection resistor 6 becomes higher than a voltage of the non-inverting input terminal of the second error amplifier 10, the voltage of the output terminal becomes low. A voltage of the gate of the output current control transistor 9 becomes low, whereby a drain current flows through the output current control transistor 9. As a result, a voltage of the gate of the output transistor 1 becomes high, whereby the drain current of the output transistor 1 is controlled to become small.

Figure 2:
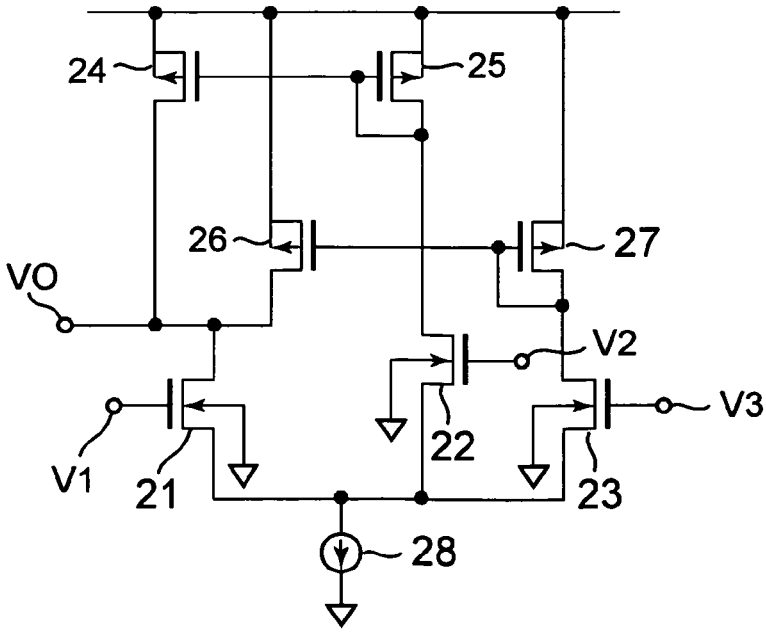
FIG. 2 is a circuit diagram of a second error amplifier circuit of the overcurrent protection circuit according to the present invention.

FIG. 2 illustrates a specific circuit example of the second error amplifier 10.

The second error amplifier 10 includes an NMOS transistor 21 having a gate serving as an inverting input terminal V1, an NMOS transistor 22 having a gate serving as a first non-inverting input terminal V2, an NMOS transistor 23 having a gate serving as a second non-inverting input terminal V3, a PMOS transistor 24 and a PMOS transistor 25 which form a current mirror circuit provided between the first non-inverting input and the inverting input, a PMOS transistor 26 and a PMOS transistor 27 which form a current mirror circuit provided between the second non-inverting input and the inverting input, and a constant current source 28 which determines a consumption current of the second error amplifier 10. Those transistors are designed to have the same size, and hence an equal current flows through the two current mirror circuits when input voltages thereof are equal therebetween. In the two non-inverting input terminals of the second error amplifier 10, a second reference voltage Vref2 of the second reference voltage circuit 11 is input to the first non-inverting input terminal V2, and the divided voltage Vdiv is input to the second non-inverting input terminal V3.

Here, in the second error amplifier 10 of FIG. 2, a ratio of sizes of the NMOS transistors 21, 22, and 23, for example, a ratio of an area size W×L (width×length) is set to be 2:1:1, voltages of the respective input terminals are represented by V1, V2, and V3, the output voltage is represented by VO, and an amplification factor is represented by A, whereby a relationship thereamong is expressed as follows.

$$VO=A(((V2+V3)/2)-V1) \quad (1)$$

That is, the second error amplifier 10 amplifiers a difference between an average value of the voltages of the first non-inverting input terminal V2 and the second non-inverting input terminal V3 and a value of the voltage of the inverting input terminal V1.

Figure 3:
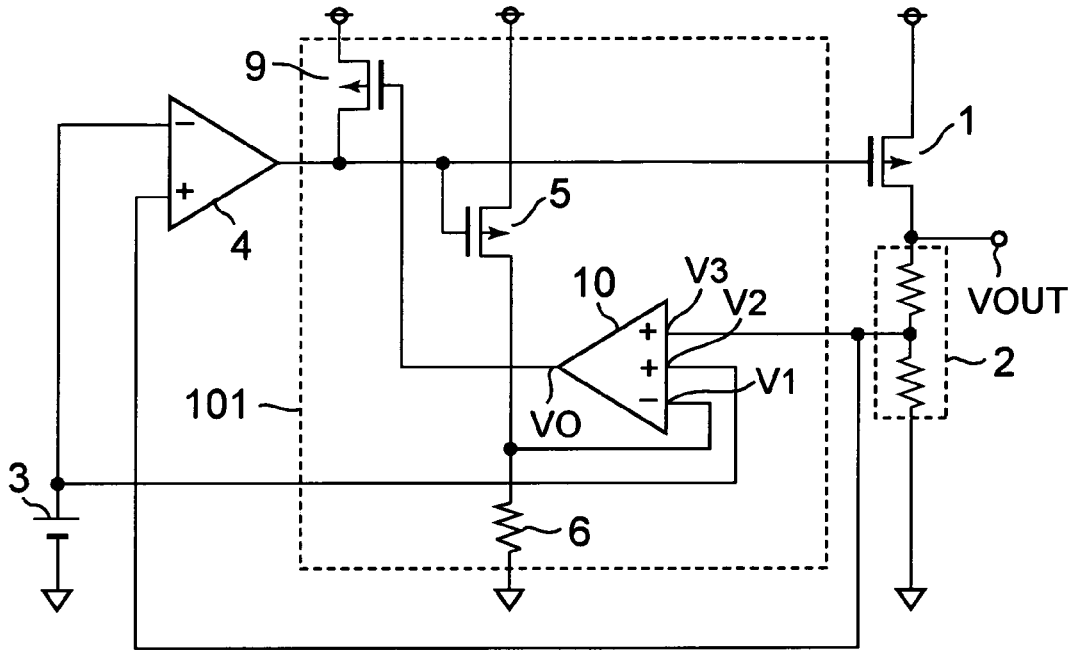
FIG. 3 is a circuit diagram of a voltage regulator including an overcurrent protection circuit according to a modification of the first embodiment of the present invention.
Figure 4:
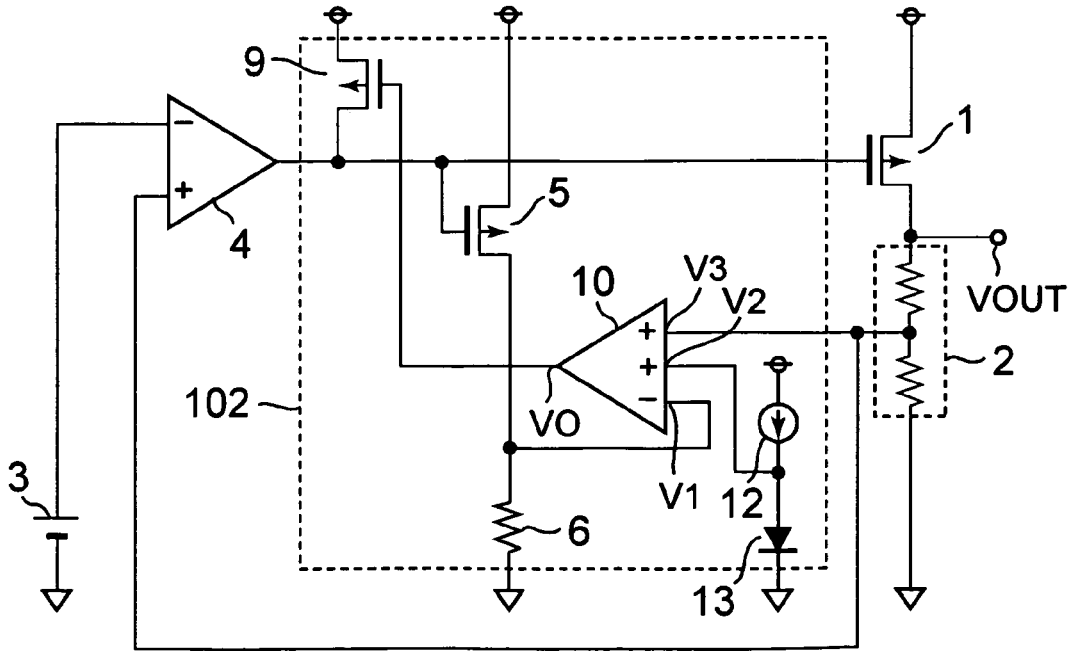
FIG. 4 is a circuit diagram of a voltage regulator including an overcurrent protection circuit according to a second embodiment of the present invention.
Figure 5:
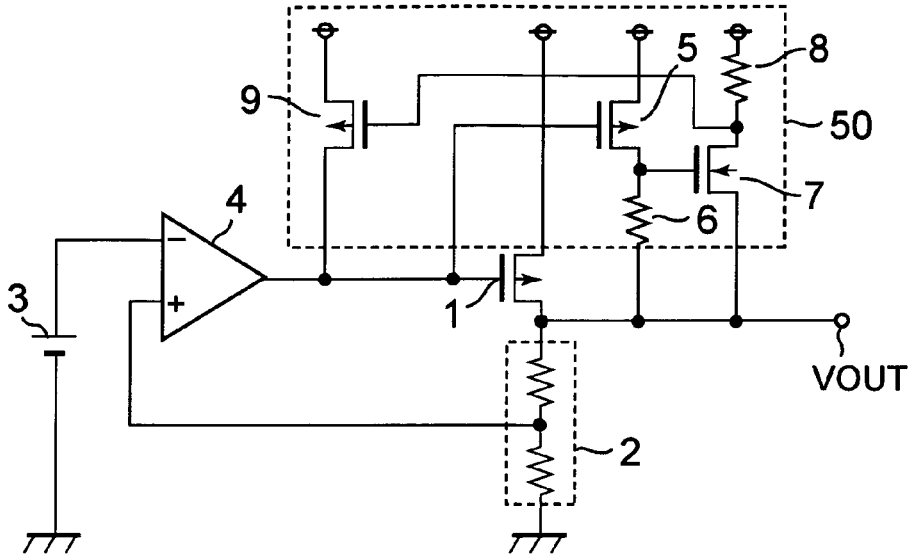
FIG. 5 PRIOR ART
FIG. 5 is a circuit diagram of a conventional voltage regulator including an overcurrent protection circuit.
Figure 6:
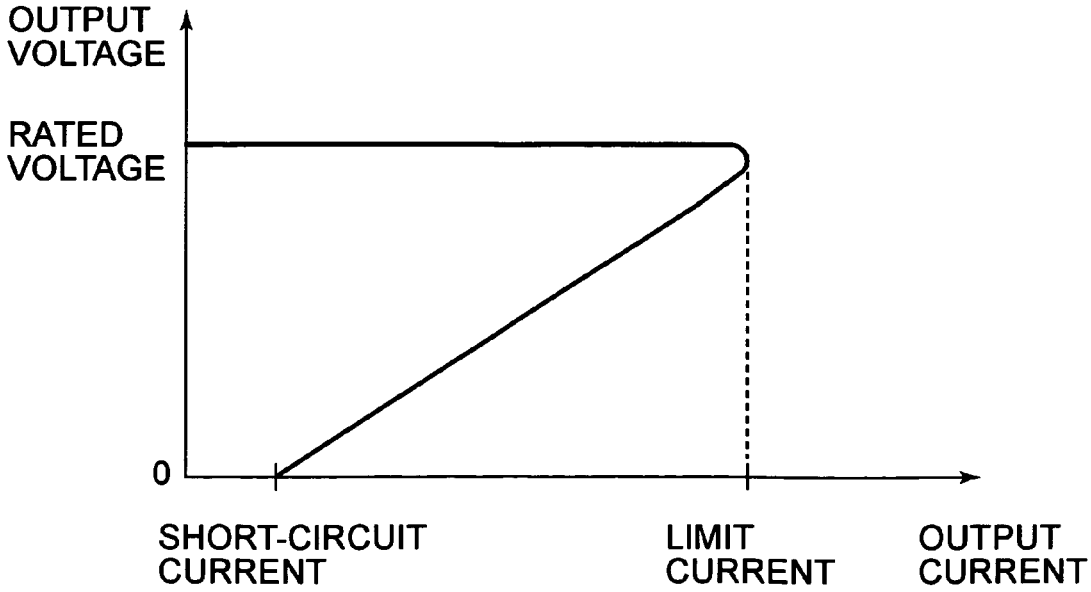
FIG. 6 is a graph of fold-back drooping current-voltage characteristics of a voltage regulator including an overcurrent protection circuit.

The second error amplifier 10 of FIG. 2 described above is applicable to a voltage regulator according to a second embodiment of the present invention, which is illustrated in FIG. 3 and FIG. 4.

The overcurrent protection circuit 100 as described above has a function of operating as follows to protect the circuit from the overcurrent.

In the case where the output current of the output terminal Vout increases, the detection current in accordance with the output current flows through the output current detection transistor 5. When the detection current flows through the detection resistor 6, the voltage of the inverting input terminal V1 of the second error amplifier 10 increases. The second reference voltage Vref2 is input to the first non-inverting input terminal V2 of the second error amplifier 10, and the divided voltage Vdiv is input to the second non-inverting input terminal V3 thereof. In a normal operating state, the divided voltage Vdiv is equal to the second reference voltage Vref2, and the voltage of the inverting input terminal V1 is smaller than the second reference voltage Vref2. Accordingly, the output terminal of the second error amplifier 10 is kept to have a high-level voltage, and the output current control transistor 9 is turned off.

Here, when the overcurrent flows into the output terminal Vout because of short-circuit of a load or the like, the detection current of the output current detection transistor 5 also becomes larger in response to this, and the detection current flows through the detection resistor 6. Accordingly, the voltage of the inverting input terminal V1 of the second error amplifier 10 gradually increases. The voltage of the output terminal Vout decreases because of the short-circuit of the load, and the voltage of the second non-inverting input terminal V3 of the second error amplifier 10 decreases. Then, when the voltage of the inverting input terminal V1 becomes higher than the average value of the second reference voltage Vref2 of the first non-inverting input terminal V2 and the divided voltage Vdiv of the second non-inverting input terminal V3, the voltage of the output terminal of the second error amplifier 10 gradually decreases. Accordingly, a voltage between the gate and the source of the output current control transistor 9 decreases, and the drain current flows through the output current control transistor 9, thereby allowing a voltage between the gate and the source of the output transistor 1 to increase.

Further, when the voltage of the output terminal Vout decreases to be the ground potential, the divided voltage Vdiv of the second non-inverting input terminal V3 of the second error amplifier 10 decreases to be the ground potential. However, the second reference voltage Vref2 is input to the first non-inverting input terminal V2 of the second error amplifier 10, and thus the voltage which is compared with the voltage of the inverting input terminal V1 does not decrease to be lower than Vref2/2. Therefore, in the voltage regulator according to this embodiment, the short-circuit current value does not decrease to be zero, thereby improving the starting characteristics.

The accuracy of the limit current value of the voltage regulator according to the first embodiment is determined by the accuracy of a resistance value of the detection resistor 6 and the accuracy of the second reference voltage value. Those characteristics can be easily determined when the voltage regulator is manufactured, and hence it is possible to adjust those characteristics through trimming with accuracy.

Accuracy of the short-circuit current value is determined by a resistance value of the detection resistor 6, the second reference voltage value Vref2, the divided voltage value, and an area ratio between a pair of differential transistors of the second error amplifier 10. Variations in area ratio between the transistors are smaller than variations in absolute value of threshold voltage value of the transistor.

In other words, the short-circuit current can be determined by the second reference voltage Vref2 which can be set with accuracy or the like, and hence it is easy to adjust output current-output voltage characteristics to desired characteristics. Accordingly, it is possible to reduce the short-circuit current without impairing the starting characteristics of the voltage regulator.

FIG. 3 illustrates a circuit diagram of a voltage regulator according to a modification of the first embodiment. In the voltage regulator of FIG. 3, the first non-inverting input terminal V2 of the second error amplifier 10 is input with the reference voltage Vref of the reference voltage circuit 3 in place of the second reference voltage Vref2. In this manner, the overcurrent protection circuit capable of reducing the short-circuit current with accuracy can be realized as well even when the voltage of the first non-inverting input terminal V2 of the second error amplifier 10 is supplied from the reference voltage circuit 3. Alternatively, a voltage which is obtained by dividing the reference voltage Vref by a division resistor may be input to the first non-inverting input terminal V2 of the second error amplifier 10.

FIG. 4 illustrates a circuit diagram of a voltage regulator according to a second embodiment. The voltage regulator of FIG. 4 is one in which the overcurrent protection circuit of the first embodiment is replaced by an overcurrent protection circuit 102. The overcurrent protection circuit 102 includes an output current detection transistor 5 which is a PMOS transistor, a detection resistor 6, an output current control transistor 9 which is a PMOS transistor, a second error amplifier 10, a constant current circuit 12, and a diode 13.

The output current detection transistor 5 has a gate connected to an output terminal of the error amplifier 4, a source connected to the input power supply, and a drain connected to one terminal of the detection resistor 6. The detection resistor 6 has the other terminal connected to the ground. The constant current circuit 12 and the diode 13 are connected in series between the input power supply and the ground in a forward direction. The second error amplifier 10 has the inverting input terminal connected to the one terminal of the detection resistor 6, one non-inverting input terminal connected to a connection point between the constant current circuit 12 and the diode 13, and the other non-inverting input terminal connected to the output terminal of the output voltage divider circuit 2. The output terminal of the second error amplifier 10 is connected to the gate of the output current control transistor 9. The output current control transistor 9 has the source connected to the input power supply and the drain connected to the gate of the output transistor 1.

The constant current circuit 12 and the diode 13 form a temperature detection circuit which outputs a voltage Vtemp which decreases in proportion to a temperature from a connection point therebetween. In general, in the case where a constant forward current is caused to flow through a pn junction silicon diode, a voltage drop thereof is about 0.6 V at a room temperature (25° C.), and temperature characteristics of roughly −2.0 mV/° C. (which differs depending on a current or an individual element) are exhibited. Accordingly, when the constant current circuit 12 and the diode 13 are connected in series, the temperature detection circuit can be formed thereby.

In the normal operating state, the voltage Vtemp is set to be equal to or larger than the divided voltage Vdiv.

In the overcurrent protection circuit 102 employing the above-mentioned temperature detection circuit, when an internal temperature of the voltage regulator increases, the output voltage Vtemp of the temperature detection circuit, that is, an input voltage of the first non-inverting input terminal V2 of the second error amplifier 10 decreases. As a result, a set value of the limit current decreases. In this manner, a value of the limit current at high temperature is made to be smaller compared with room temperature, with the result that a heating amount due to the overcurrent at high temperature can be reduced.

The overcurrent protection circuit 102 as described above has a function of protecting the circuit from the overcurrent through the following operation.

In the case where the output current of the output terminal Vout increases, the detection current corresponding to the output current flows through the output current detection transistor 5. When the detection current flows through the detection resistor 6, the voltage of the inverting input terminal V1 of the second error amplifier 10 increases. The voltage Vtemp at the connection point between the constant current circuit 12 and the diode 13 is input to the first non-inverting input terminal V2 of the second error amplifier 10, and the divided voltage Vdiv is input to the second non-inverting input terminal V3. In the normal operating state at room temperature, the voltage Vtemp is equal to the divided voltage Vdiv, and the voltage of the inverting input terminal V1 is lower than the divided voltage Vdiv. Accordingly, the output terminal of the second error amplifier 10 is kept to have a high-level voltage, and the output current control transistor 9 is turned off.

Here, the overcurrent flows into the output terminal Vout, and the output current detection transistor 5 feeds the detection current to the detection resistor 6, whereby the voltage of the inverting input terminal V1 of the second error amplifier 10 gradually increases. Further, the voltage of the output terminal Vout decreases because of short-circuit of the load, whereby the voltage of the second non-inverting input terminal V3 of the second error amplifier 10 decreases. Then, when the voltage of the inverting input terminal V1 becomes higher than the average value of the voltage Vtemp of the first non-inverting input terminal V2 and the divided voltage Vdiv of the second non-inverting input terminal V3, the voltage of the output terminal of the second error amplifier 10 gradually decreases. As a result, the voltage between the gate and the source of the output current control transistor 9 decreases, and the drain current flows through the output current control transistor 9, thereby allowing the voltage between the gate and the source of the output transistor 1 to increase.

Further, when the overcurrent flows, the voltage of the output terminal Vout decreases to the ground potential. That is, the divided voltage Vdiv of the second non-inverting input terminal V3 of the second error amplifier 10 decreases to the ground potential. However, the voltage Vtemp is input to the first non-inverting input terminal V2 of the second error amplifier 10, and hence the voltage which is compared with the voltage of the inverting input terminal V1 does not become smaller than Vtemp/2. Accordingly, in the voltage regulator according to this embodiment, the short-circuit current value does not decrease to zero, thereby improving the starting characteristics.

The voltage Vtemp of the temperature detection circuit is a voltage value which is determined based on a bandgap voltage of pn junction and its temperature characteristics, and is much smaller than variations in threshold voltage of the transistor.

Therefore, compared with the conventional overcurrent protection circuit which is controlled by the threshold voltage of the transistor, the limit current and the short-circuit current can be set more accurately. As a result, the output current-output voltage characteristics can be easily adjusted to the desired characteristics, with the result that the short-circuit current can be reduced without impairing the starting characteristics of the voltage regulator.

Further, in the voltage regulator according to this embodiment, the voltage Vtemp of the temperature detection circuit is input to the first non-inverting input terminal V2, and thus the limit current value and the short-circuit current value can be controlled by the internal temperature of the voltage regulator. Accordingly, heat generation can be suppressed effectively.

It should be noted that, in the overcurrent protection circuit according to the embodiments of the present invention, the output voltage of the output voltage divider circuit 2 is input to one of the non-inverting input terminals of the second error amplifier 10, but the present invention is not limited thereto. Any voltage can be input as long as being a voltage corresponding to the output voltage.

Further, the second error amplifier 10 is set so that the difference between the value of the voltage of the inverting input terminal V1 and the average value of the voltages of the first non-inverting input terminal V2 and the second non-inverting input terminal V3 is amplified. However, the present invention is not limited thereto as long as there exists a ratio which is appropriate for setting the short-circuit current value.

What is claimed is:

1. A voltage regulator, comprising:

a first error amplifier circuit for amplifying a difference between a first reference voltage and a voltage that is based on an output voltage of an output transistor, outputting the amplified difference, and controlling a gate of the output transistor; and an overcurrent protection circuit for detecting an overcurrent flowing through the output transistor and limiting a current of the output transistor, the overcurrent protection circuit comprising:

an output current detection transistor for feeding a detection current in accordance with an output current of the output transistor, the output current detection transistor having a gate controlled by an output voltage of the first error amplifier circuit;

a voltage generation circuit for generating a voltage based on the detection current from the output current detection transistor;

a second error amplifier circuit for amplifying a difference between the voltage generated by the voltage generation circuit and a voltage that is set by a second reference voltage and a voltage based on the output voltage, and for outputting the amplified difference, the second reference voltage being supplied from a temperature detection circuit in which an output voltage thereof changes in accordance with temperature; and an output current limiting transistor for controlling a gate voltage of the output transistor, the output current limiting transistor having a gate that is controlled by an output of the second error amplifier circuit.

2. A voltage regulator according to claim 1; wherein the temperature detection circuit comprises a constant current circuit and a diode connected in series; and wherein the second reference voltage is output in accordance with a forward voltage of the diode.

3. A voltage regulator according to claim 1; wherein the gate of the output current detection transistor is connected to an output terminal of the first error amplifier circuit; and wherein the output current detection circuit has a source connected to an input power supply, and a drain connected to a first terminal of the voltage generation circuit.

4. A voltage regulator according to claim 3; wherein the voltage generation circuit has a second terminal connected to a ground; and wherein the temperature detection circuit comprises a constant current circuit and a diode connected in series between the input power supply and the ground in a forward direction.

5. A voltage regulator according to claim 4; wherein the second error amplifier circuit has an inverting input terminal connected to the first terminal of the voltage generation circuit, a first non-inverting input terminal connected to a connection point between the constant current circuit and the diode.

6. A voltage regulator according to claim 5; further comprising an output voltage divider circuit having an output terminal connected to a non-inverting input terminal of the first error amplifier circuit, and a reference voltage circuit that generates the first reference voltage and that has an output terminal connected to an inverting input terminal of the first error amplifier circuit; and wherein the second error amplifier circuit has a second non-inverting input terminal connected to the output terminal of the output voltage divider circuit.

7. A voltage regulator according to claim 6; wherein the second error amplifier circuit has an output terminal connected to the gate of the output current limiting transistor; and wherein the output current limiting transistor has a source connected to the input power supply and a drain connected to a gate of the output transistor.

8. A voltage regulator for outputting a constant voltage to an output terminal of the voltage regulator, the voltage regulator comprising:

an output transistor;

an output voltage divider circuit that divides a voltage of the output terminal;

a reference voltage circuit that outputs a reference voltage;

a first error amplifier that compares the divided voltage with the reference voltage, amplifies a difference between the divided voltage and the reference voltage based on an output voltage of the output transistor, and outputs the amplified difference, the output transistor being controlled by an output voltage of the first error amplifier and operating so that the divided voltage is equal to the reference voltage to thereby maintain the voltage of the output terminal constant; and an overcurrent protection circuit that monitors a current flowing through the output transistor, the overcurrent protection circuit comprising:

an output current detection transistor that outputs a detection current in accordance with an output current of the output transistor;

a voltage generation circuit that generates a voltage based on the detection current from the output current detection transistor;

a temperature detection circuit that outputs a voltage that varies in accordance with temperature;

a second error amplifier circuit that amplifies a difference between the voltage from the temperature detection circuit and the voltage generated by the voltage generation circuit; and an output current limiting transistor that controls a gate voltage of the output transistor, the output current limiting transistor having a gate that is controlled by an output of the second error amplifier circuit.

9. A voltage regulator according to claim 8; wherein the temperature detection circuit comprises a constant current circuit and a diode connected in series; and wherein the second reference voltage is output in accordance with a forward voltage of the diode.

10. A voltage regulator according to claim 8; wherein the gate of the output current detection transistor is connected to an output terminal of the first error amplifier circuit; and wherein the output current detection circuit has a source connected to an input power supply, and a drain connected to a first terminal of the voltage generation circuit.

11. A voltage regulator according to claim 10; wherein the voltage generation circuit has a second terminal connected to a ground; and wherein the temperature detection circuit comprises a constant current circuit and a diode connected in series between the input power supply and the ground in a forward direction.

12. A voltage regulator according to claim 11; wherein the second error amplifier circuit has an inverting input terminal connected to the first terminal of the voltage generation circuit, a first non-inverting input terminal connected to a connection point between the constant current circuit and the diode.

13. A voltage regulator according to claim 12; further comprising an output voltage divider circuit having an output terminal connected to a non-inverting input terminal of the first error amplifier circuit, and a reference voltage circuit that generates the first reference voltage and that has an output terminal connected to an inverting input terminal of the first error amplifier circuit; and wherein the second error amplifier circuit has a second non-inverting input terminal connected to the output terminal of the output voltage divider circuit.

14. A voltage regulator according to claim 13; wherein the second error amplifier circuit has an output terminal connected to the gate of the output current limiting transistor; and wherein the output current limiting transistor has a source connected to the input power supply and a drain connected to a gate of the output transistor.

* * * * *